US006776271B2

(12) United States Patent
Chen

(10) Patent No.: US 6,776,271 B2
(45) Date of Patent: Aug. 17, 2004

(54) TRAVELING CASE WITH ERECTLY EXPANDED CASE BODY

(76) Inventor: Line-Ti Chen, No. 7-11, Anshijuang, Changhua City, Changhua Country (TW)

( * ) Notice: Subject to any disclaimer, the term of this patent is extended or adjusted under 35 U.S.C. 154(b) by 0 days.

(21) Appl. No.: 10/209,902

(22) Filed: Aug. 2, 2002

(65) Prior Publication Data

US 2004/0020732 A1 Feb. 5, 2004

(51) Int. Cl.[7] ..... A45C 7/00
(52) U.S. Cl. ..... 190/18 A; 190/107; 190/115
(58) Field of Search ..... 190/18 A, 18 R, 190/115, 117, 118, 103, 107, 104, 105, 127; 280/37, 655, 655.1, 47.315; 16/114.1, 411

(56) References Cited

U.S. PATENT DOCUMENTS 5,664,652 A * 9/1997 Shamah ..... 190/18 A
5,819,891 A * 10/1998 Wang et al. ..... 190/103
6,047,798 A * 4/2000 Lin ..... 190/18 A
6,179,101 B1 * 1/2001 Lin ..... 190/103
6,357,567 B1 * 3/2002 Tsai ..... 190/18 A

* cited by examiner

*Primary Examiner*—Lien Ngo
(74) *Attorney, Agent, or Firm*—Troxell Law Office PLLC

(57) ABSTRACT

The traveling case with an erectly expanded case body consists of one case body, one adjustable shaft pair, one positioning and binding base and one wheel and foot base. The outer shaft of the adjustable shaft pair passes through the shaft installation hole on the positioning and binding base and gets fixed at the rear insdie the body. A stretchable and foldable mezzanine is installed on the body that expands horizontally against the moving direction of the adjustable shaft. That is, the zipper opens and closes vertically against the movement of the adjustable shaft. Therefore, when the above case body is stretched, the inner space is increased and the traveling case will not topple and fall, which enhances the steadiness of the traveling case.

1 Claim, 5 Drawing Sheets

TRAVELING CASE WITH ERECTLY EXPANDED CASE BODY

FIELD OF THE INVENTION

The present invention is a traveling case with an erectly expanded case body, especially those whose mezzanine stretches parallelly with the movement of the adjustable shaft. That is, the zipper opens and closes vertically to the movement of the adjustable shaft. Therefore, when the mezzanine of the above case body is stretched out, the traveling case will not topple and fall.

BACKGROUND OF THE INVENTION

Currently, passengers traveling abroad or outdoors will bring with them one or several traveling cases. Please refer to FIGS. 1A and B, in which the traveling case 5 enables passengers to place many cloths and daily supplies. Traditional traveling cases are made of one adjustable pair of shafts 51, one case body 52, one cover 53, one pair of wheels 54 and one pair of feet 55. The adjustable shafts 51 are fixed on the rear outside the case body 5 by rivets or other fixtures. Moreover, on the back ends of the body's bottom are set with a pair of wheels 54 and a pair of feet on the front ends. Inside the above case body 52 is a frame board with its bottom connected to the bottom of the cover 53 and its top attached with a zipper 56, allowing the passenger to open and close the case body. In an attempt to place more objects or cloths inside the case body 52, a zipper 531 around it enables passengers to expand the mezzanine.

Traditional traveling case 5 increases their inner space by the mezzanine expanded; however, the wheels 54 and feet 55 are still fixed at the bottom of the case body 52, unable to move forward to the bottom's front ends of the cover 53 along with the expansion of the cover's 53 mezzanine. As a result, traditional traveling case 5, after the inner space being expanded, might topple and fall when being placed still because of the center of gravity moving forward and that makes it unable to remain balanced.

In view of such a breakage problem for traditional traveling cases, the inventor of the present invention was devoted to finding a solution and accomplished structural improvement for traveling cases.

SUMMARY OF THE INVENTION

The main objective of this present invention is to provide a traveling case with an erectly expanded case body by means of the press button on the positioning and binding base. When the user attempts to extend the space of the traveling case, he/she can press down the press button that controls the tenon of the pull-and-fasten mechanism inside the positioning and binding base, departing the tenon from the third hole of the outer shaft, which in turn moves the positioning and binding base upward to have the tenon stuck in the fourth hole above the third hole, thus dramatically increases the inner space of the case body.

Another objective of the present invention is to provide a traveling case with an erectly expanded case body in which the mezzanine of the case body expands horizontally with the movement of the adjustable shaft. The positioning and binding base on the body moving up and down along the adjust shaft allows the user to expand or fold up the traveling case. When the above positioning and binding base moves upward and expands the mezzanine of the case body, the center of gravity, instead of moving forward, moves upward, eliminating the possibility of toppling, thus keeps the traveling case in balance.

The above traveling case with an erectly expanded case body consists of:

One body with one upward press button and one mezzanine zipper for the expansion and folding of the mezzanine. On the front there is an opening:

One adjustable shaft pair containing an adjustable shaft with the pull-and-fasten mechanism inserted inside through outer shaft. On the shaft is a handle with a press button on the fillister of the handle;

One positioning and binding base with the pull-and-fasten mechanism. On top of it are a shaft installation hole and one fillister with a press button;

One wheel and foot base at the bottom of the case body. On the front of the foot base are a pair of feet with a pair of wheels on the back thereof;

The adjustable shaft of the adjustable shaft pair passes through the shaft installation hole of the positioning and binding base and got riveted on the back of the case body. Pressing down the press button on the handle of the adjustable shaft pulls the adjustable shaft upward, departing the tenon of the pull-and-fasten mechanism on the adjustable shaft from the first hole of the outer shaft and then engages the second hole of the outer shaft. In front of the case body is set with a zipper for the opening and closing of the body, allowing the user to place or take out the stuff. The zipper keeps the mezzanine folded up by having the tenon of the pull-and-fasten mechanism on the positioning and binding base stuck on the third hole of the outer shaft. When attempting to stretch out the mezzanine of the body, the user simply presses down the press button on the positioning and binding base, departing the tenon of the pull-and-fasten mechanism from the third hole, moving the positioning and binding base upward to have the tenon of the pull-and-fasten mechanism stuck on the fourth hole of the outer shaft, thus allow the user to place more cloth and stuff in the body. With the wheels and feet respectively fixed on the front and back ends of the body's bottom, the traveling case would not topple and fall as traditional traveling case, which in turn enhances its steadiness.

BRIEF DESCRIPTION OF THE DRAWINGS

The drawings disclose an illustrative embodiment of the present invention which serves to exemplify the various advantages and objects hereof, and are as follows.

DETAILED DESCRIPTION OF THE INVENTION

Figure 1B:
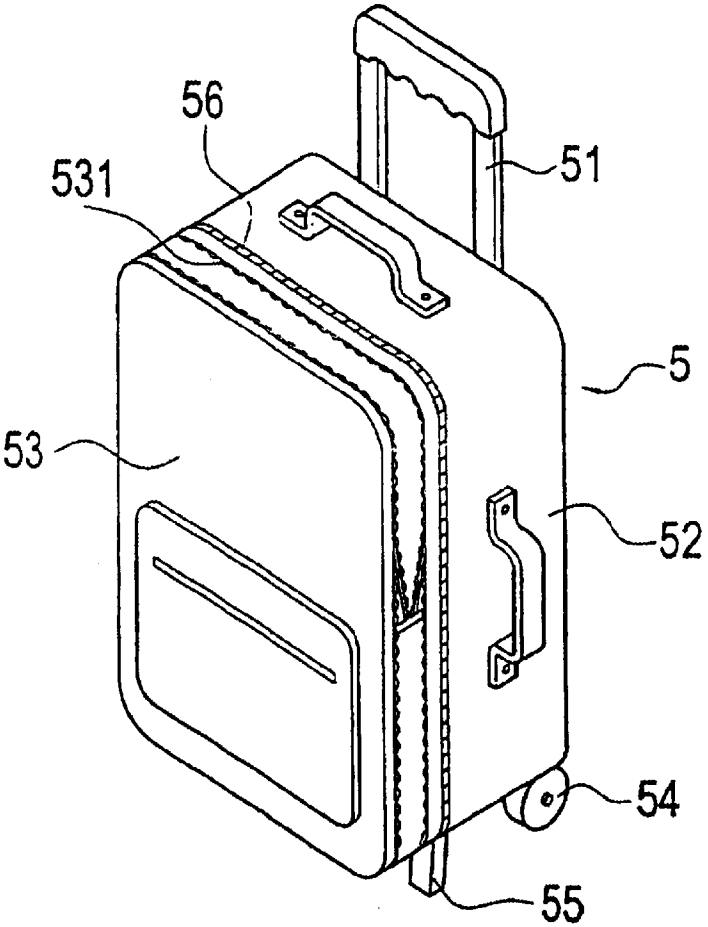
FIG.1(B) PRIOR ART
FIG. 1B is a diagram about traditional traveling cases being stretched.
Figure 1:
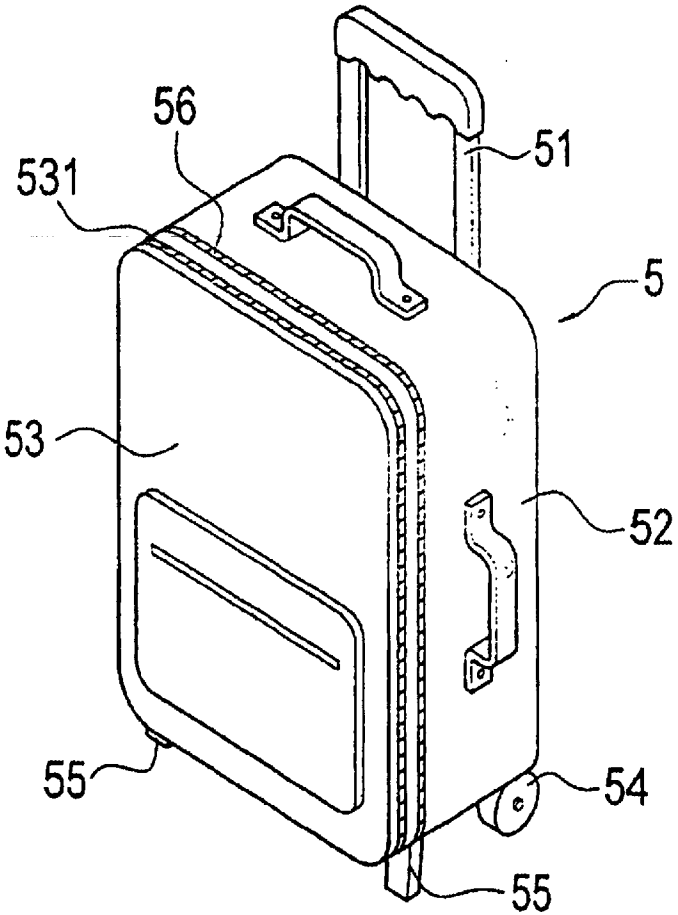
FIG.1 (A) PRIOR ART
FIG. 1A is a diagram about traditional traveling cases.
Figure 2B:
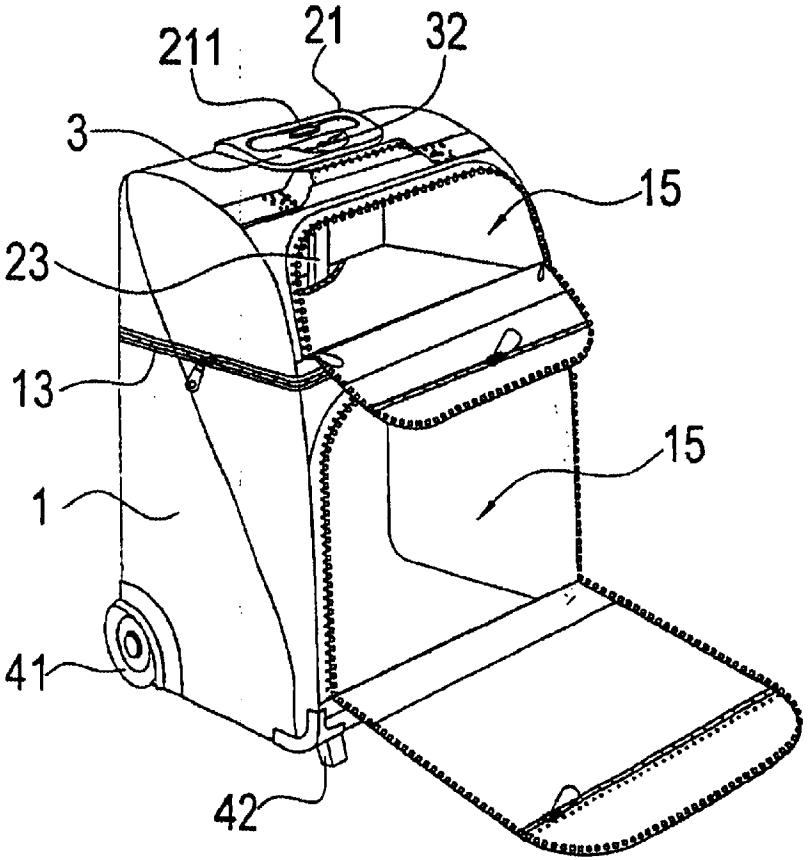
FIG. 2B is a diagram about the traveling case with an erectly expanded case body for the present invention being opened.
Figure 2A:
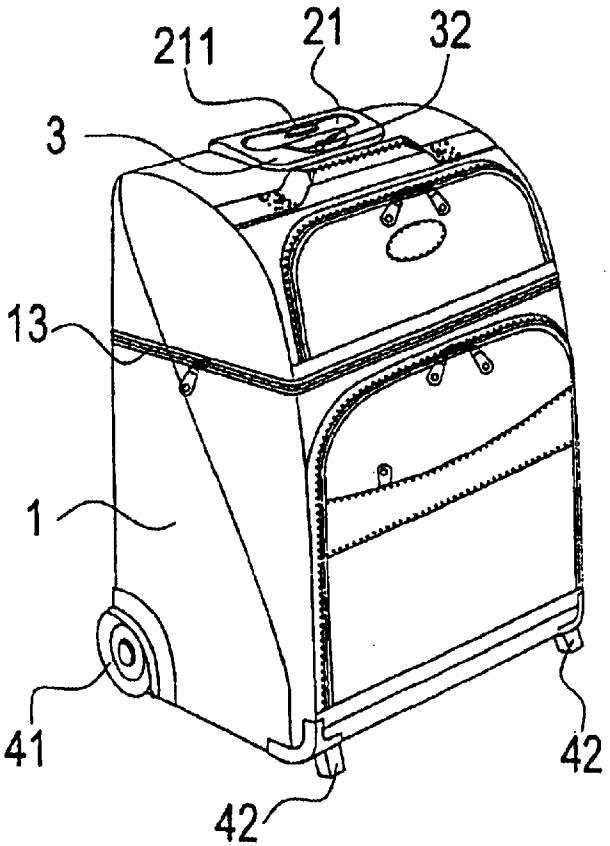
FIG. 2A is a diagram about the traveling case with an erectly expanded case body of the present invention.
Figure 3B:
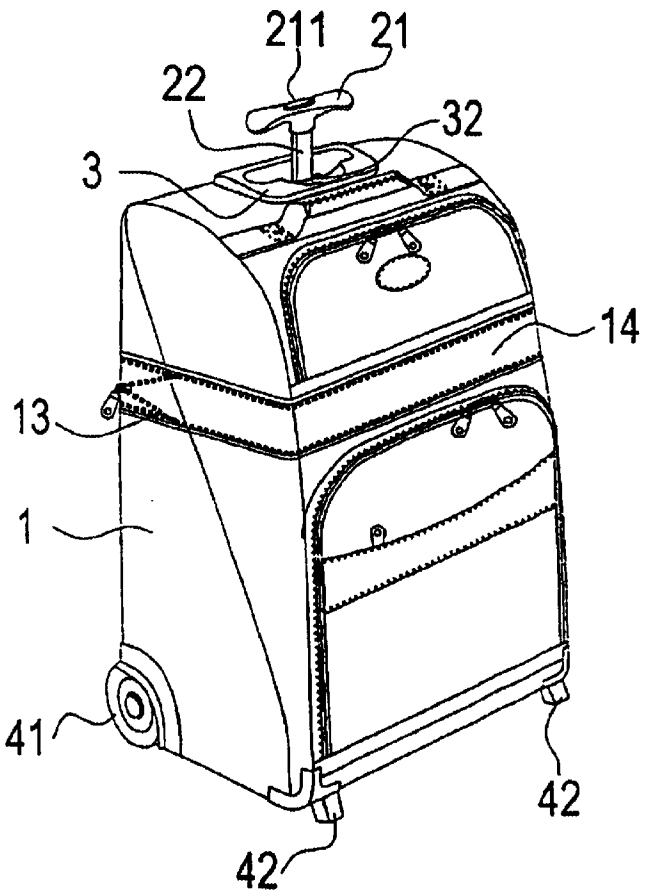
FIG. 3B is a operational diagram about the adjustable shaft and the expanded mezzanine of the traveling case with an erectly expanded case body for the present invention.
Figure 3A:
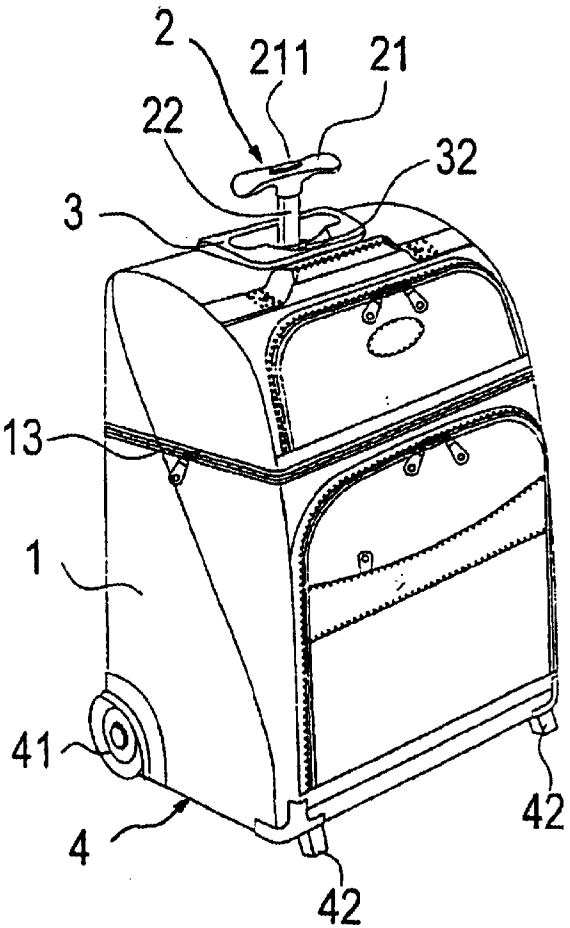
FIG. 3A is a operational diagram about the adjustable shaft of the traveling case with an erectly expanded case body of for the present invention.
Figure 5C:
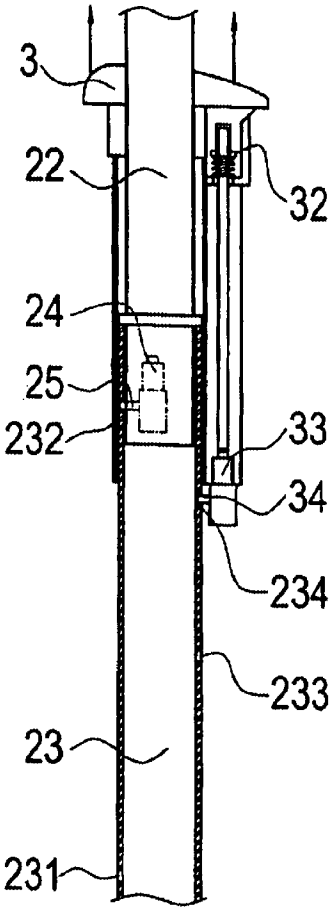
FIG. 5C is a diagram about the tenon of the pull-and-fasten mechanism of the positioning and binding base of the traveling case with an erectly expanded case body for the present invention, in which the tenon is stuck on the fourth hole of the outer shaft after the positioning and binding base moving upward.
Figure 5B:
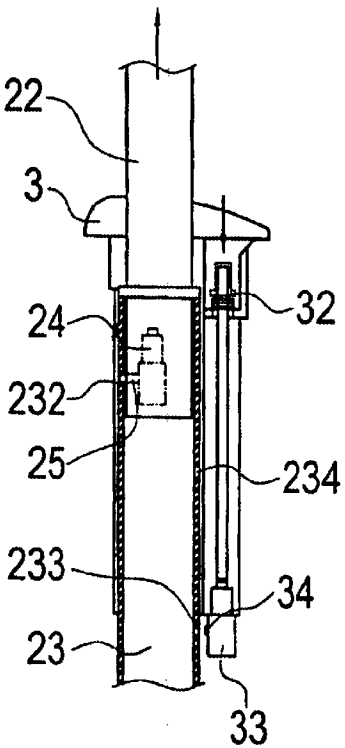
FIG. 5B is a diagram about the tenon of the pull-and-fasten mechanism on the positioning and binding base of the traveling case with an erectly expanded case body for the present invention, in which the tenon is departed from the third hole of the outer shaft and got stuck on the second hole of the outer shaft after the adjustable shaft moving upward.
Figure 5A:
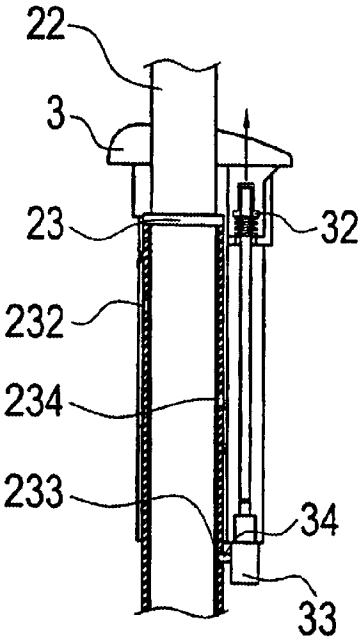
FIG. 5A is a diagram about the tenon of the pull-and-fasten mechanism on the positioning and binding base of the traveling case with an erectly expanded case body for the present invention, in which the tenon is stuck on the third hole of the outer shaft.
Figure 4:
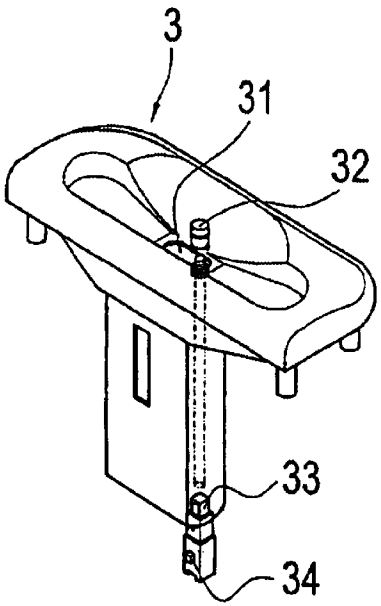
FIG. 4 is a diagram about the positioning and binding base of the traveling case with an erectly expanded case body for the present invention.

Please refer to FIGS. 2A and B and FIGS. 3A and B for the traveling case with an erectly expanded case body for the present invention, in which it consists of one case body 1, one adjustable shaft pair 32, one positioning and binding base 3 and one wheel and foot base 4. For the relationship among each component of the present invention, please refer to FIGS. 3A and B. The case body 1 is a cannular container with an installation hole (not shown) on the top. The positioning and binding base 3 has an adjustable shaft installation hole 31, allowing the outer shaft 23 of the adjustable shaft pair 2 to be installed in the adjustable shaft installation hole 31 and then connecting the bottom of the positioning and binding base 3 to the installation hole of the case body 1 and the wheels 41 and the feet 42 of the wheel and foot base 4 on the four ends of the body's 1 bottom.

For a closer look at the connection among each component of the present invention, please refer to FIGS. 3A and B, FIG. 4, FIGS. 5A, 5B, and 5C. The adjustable shaft 22 of the adjustable shaft pair with the pull-and-fasten mechanism 24 is inserted into the outer shaft 23 which is then inserted through the adjustable shaft installation hole 31 of the positioning and binding base 3. A pull-and-fasten mechanism 33 on the positioning and binding base 3 removably engages the outer shaft 23. The outer shaft 23 is positioned a distance from the adjustable shaft installation hole 31. After the outer shaft 23 passing through the shaft installation hole 31, the bottom of the position and binding base 3 is connected to the top of the installation hole on the case body 1 and the outer shaft 23 is connected on the back inside the case body 1 by rivets or other fixtures. The top of the adjustable shaft 22 of the above adjustable shaft pair 2 is installed inside the installation hole at the bottom of the handle 21. On the top of the handle 21 is a fillister with a press button 211 inside. In an attempt to move the adjustable shaft 22 up and down, the user simply presses down the press button 211 on the handle 21 that is connected to and controls the pull-and-fasten mechanism 24 of the adjustable shaft 22. When the tenon 25 of the pull-and-fasten mechanism 24 departs from the first hole 231 of the outer shaft 23, the handle 21 of the adjustable shaft 22 is pulled upward, thus moves the tenon 25 of the pull-and-fasten mechanism 24 inside the adjustable shaft 22 to get stuck on the second hole 232 of the outer shaft 23.

The positioning and binding base 3 functions as the adjustable shaft of the adjustable shaft pair 2 and the handle of the adjustable shaft. The adjustable shaft moves along inside the outer shaft 23, while the positioning and binding base 3 moves along outside the outer shaft 23. A fillister with a press button 211 is set on the handle of the adjustable shaft 21. Pressing down the press button 211 that is connected to and controls the tenon 25 of the pull-and-fasten mechanism 24 inside the adjustable shaft 22. With the pulling of the handle departs the tenon 25 of the pull-and-fasten mechanism 24 from the first hole 231 of the outer shaft 23 and lodges it to the second hole 232 above the first hole 231. A fillister with a press button also sits on the positioning and binding base 3. In an attempt to open up the case body 1, a user simply presses down the press button 32 that is connected to and directly controls the tenon 34 of the pull-and-fasten mechanism 33 inside the positioning and binding base 3, departing the tenon 34 from the third hole 233 to have it stuck on the fourth hole 234 above the third hole 233 by moving the positioning and binding base 3 upward. In this way, the inner space of the case body 1 is dramatically increased.

A zipper is provided on the opening 15 in front of the above case body 1, allowing the user to open or close the traveling case. The opening 15 enables the user to take out the suppliers even when the traveling case is erected, thus facilitating the user in taking cloths and daily suppliers without lying the traveling case flat.

The stretchable and foldable mezzanine 14 expands in parallel with the movement of the adjustable shaft pair's 2 adjustable shaft; that is, the zipper 13 of the mezzanine 14 opens and closes vertically against the adjustable shaft of the adjustable shaft pair 2. In an attempt of expanding the mezzanine 14 of the case body 1 to increase the space of the case body 1, the user first pull apart the zipper 13 of the mezzanine 14 inside the case body 1, and then presses down the press button 32 on the positioning and binding base 3, which directly controls the tenon 34 of the pull-and-fasten mechanism 33 on the positioning and binding base 3. Through the outer shaft 23 that enables the positioning and binding base 3 to slide up and down along the exterior of the outer shaft 23, the tenon 34 is departed from the third hole 233 of the outer shaft 23 and got stuck on the fourth hole 234 above the third hole 233 by moving the positioning and binding base 3 upward, thus increases the inner space of the case body 1. On the contrary, in an attempt to fold up the mezzanine 14 of the case body 1, simply presses down the press button on the positioning and binding base 3, departing the tenon 34 of the pull-and-fasten mechanism 33 of the positioning and binding base 3 from the fourth hole 234 to have it stuck on the third hole 233 by moving the positioning and binding base 3 downward. Then closing the zipper 13 of the mezzanine 14 in the case body 1 completes the folding of the mezzanine 14 of the case body 1.

After the expansion of the mezzanine 14 of the above case body 1, the user can use a hard board with a felt to fixe and support the expanded case body 1 by pasting the hard board against the felt inside the case body 1. Otherwise, a cannular and cone multi-section frame cover could be used to fix the expanded case body 1. Such a multi-section frame cover whose bottom of the first section of frame cover is connected to the case body 1. The internal diameter of the top for the first section of frame cover is the same with the external diameter of the bottom for the second section of frame cover. The internal diameter of the top for the second section of frame cover is the same with the external diameter of the bottom for the third section of frame cover, and so forth. With the inner diameter of the frame cover's top identical to the external diameter of the frame cover's bottom, the case body 1 of the expanded mezzanine 14 is fixed as the frame cover moves upward.

The wheel and foot base 4 is equipped at the bottom of the case body 1 with the wheels 41 on the back ends of the case body's 1 bottom and the feet 42 on the front ends, allowing the user to drag the traveling case by means of the wheels 41 on the back ends of the case body 1 when pulling along the adjustable shaft, providing the labor-saving function. Moreover, the expanded mezzanine 14 of the case body 1 will not cause the traveling case to topple and fall, as traditional case body 1 do, thus enhances the stability of the case body 1 with the expanded mezzanine 14.

Figure 6B:
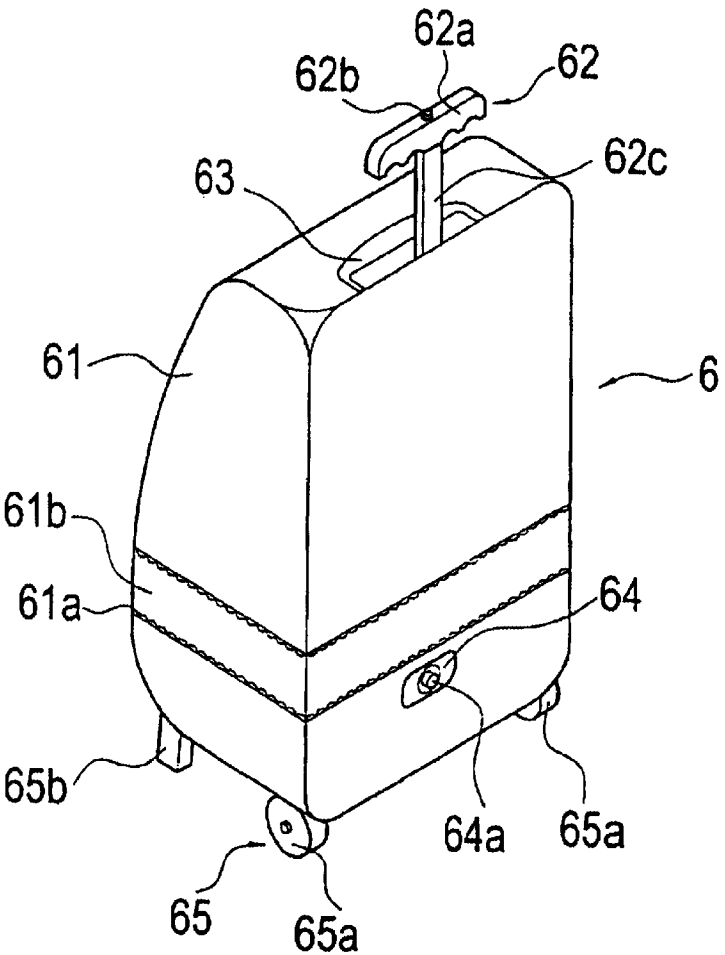
FIG. 6B is a diagram about the expansion of the above type of case body of the traveling case with an erectly expanded case body for the present invention.
Figure 6A:
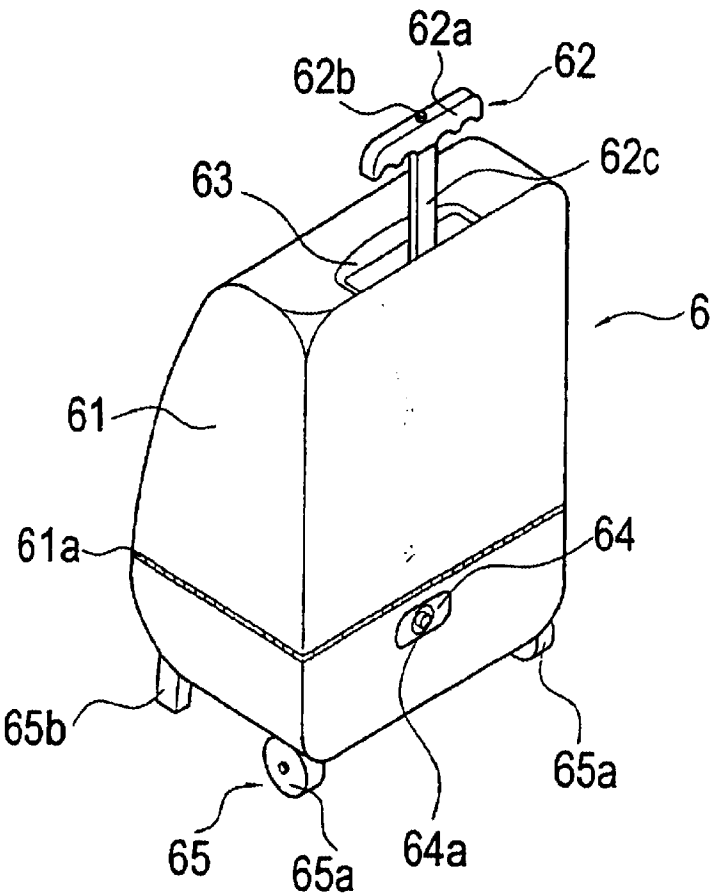
FIG. 6A is a diagram about the traveling case with an erectly expanded case body for the present invention with another type of case body.

The expanded space of the traveling case for the present invention can be designed beneath the above case body. Please refer to FIG. 6A for more detailed explanation about another structure the present invention. The case body 61 is a cannular body with a fixing base 63 placed above. On the back of the case body 61 is a positioning base 64. A sliding shaft installation hole on the fixing base 63 allows the cannular sliding shaft be inserted into the sliding shaft installation hole of the fixing base 63, and then be fixed inside the fixing base 63 on top of the sliding shaft with the bottom of the sliding shaft connected to the fixing base 64. The adjustable shaft pair 62 includes one adjustable shaft 62*c*, the handle 62*a* on the adjustable shaft 62*c* and the outer shaft. The above outer shaft is installed into the sliding shaft and fixed inside the case body 61. The wheels 65*a* and the feet 65*b* of the wheel and foot base 65 are installed on the four ends of the case body's 61 bottom.

Please refer to FIGS. 5A, 5B and 5C and FIG. 6B for more detail. The traveling case with an erectly expanded case body for the present invention is equipped with one stretchable and foldable mezzanine 61*b* at the bottom of the case body 61 that moves in parallel with the moving direction of the adjustable shaft 62*c* of the adjustable shaft pair 62; that is, the zipper 61 a of the mezzanine opens and closes vertically to the adjustable shaft 62*c* of the adjustable shaft pair 62. On the top and the back of the case body 61 are a fixing base 63 and positioning base 64, where the fixing base 63 is connected to the top of the cannular sliding shaft from its interior and the bottom of the sliding shaft is connected to the positioning base 64. The outer shaft of the adjustable shaft pair is installed inside the cannular sliding shaft with its bottom fixed inside the case body 61.

In an attempt to expand the case body 61, the user simply pressed down the press button 62*b* on the handle 62*a* of the adjustable shaft 62*c* that indirectly controls the tenon of the pull-and-fasten mechanism inside the adjustable shaft. Then, the user pulls the handle 62*a* upward to depart the tenon of the pull-and-fasten from the first hole of the outer shaft and have it stuck on the second hole above the first hole. After pulling the mezzanine's zipper 61*a* of the case body 61 apart, the user pressed down the press button 64*a* of the positioning base 64 on the back of the case body 61 that directly controls the tenon of the pull-and-fasten mechanism inside the positioning base 64, moving the positioning base 64 along with the case body 61 upward to depart the tenon from the third hole and get stuck on the fourth hole above the third hole, so as to increase the inner space of the case body 61 as well as enhances the balance of the case body 61.

After the expansion of the mezzanine of the above case body 61, the expanded case body 61 can be fixed by the multi-section frame cover. The multi-section frame cover is cannular and cone with the bottom of the first section of frame cover connected to the case body. The internal diameter of the top for the first section of frame cover is the same with the external diameter of the bottom for the second section of frame cover. The internal diameter fo the top for the second section of frame cover is the same with the external diameter of the bottom for the third section of frame cover, and so forth. With the inner diameter of the frame cover's top identical to the external diameter fo the frame cover's bottom, the case body 61 of the expanded mezzanine 61*b* is fixed as the frame cover moves upward.

When compared with other traditional technology, the traveling case with an erectly expanded case body for the present invention provides the following benefits:

The traveling case with an erectly expanded case body for the present invention eliminates the problem of the center of gravity shifting forward during the expansion of the mezzanine, which causes the traveling case to topple and fall.

The traveling case with an erectly expanded case body for the present invention allows the user to open up the opening in front of the body and take out the stuff. Such an invention makes it more convenient for the user to take out the suppliers when the case is erect, eliminating the problem of lying down the traveling case before taking out the suppliers.

Many changes and modifications in the above described embodiment of the invention can, of course, be carried out without departing from the scope thereof. Accordingly, to promote the progress in science and the useful arts, the invention is discloses and is intended to be limited only by the scope of the appended claims.

What is claimed is:

1. A traveling case with a vertically expanding body comprising:

a) a case body with a hollow interior having;

i) a pair of wheels connected to opposing sides of a back edge of a bottom of the case;

ii) a pair of feet connected to opposing sides of a front edge of a bottom of the case; and iii) an expandable mezzanine formed on a perimeter of sides of the case, the mezzanine being movable between an open position and a closed position, the mezzanine having a zipper for securing the mezzanine in the closed position;

b) an adjustable shaft pair having:

i) an outer shaft connected to the case body and having a first hole, a second hole, a third hole, and a fourth hole, the second hole positioned above the first hole, and the fourth hole positioned above the third hole;

ii) an inner shaft slidably fit within the outer shaft; and iii) a handle with a first press button connected to a first end of the inner shaft;

c) a first pull-and-fasten mechanism located on a second end of the inner shaft, the first pull-and-fasten mechanism having a first tenon, the first tenon being movable between engaged and disengaged positions relative to the first and second holes in the outer shaft, wherein the inner shaft is slidable within the outer shaft when the first tenon is in the disengaged position, the inner shaft is fixed in a retracted position when the first tenon engages the first hole in the outer shaft, and the inner shaft is fixed in an extended position when the first tenon engages the second hole in the outer shaft; and d) a second pull-and-fasten mechanism having a second-press button and a second tenon, the second pull-andfastening being connected to the case body the second tenon being movable between engaged and disengaged positions relative to the outer shaft, wherein the mezzanine of the case body is movable between retracted and extended positions when the second tenon is in the disengaged position, the mezzanine is fixed in the retracted position when the second tenon engages the third hole in the outer shaft, and the mezzanine is fixed in the extended position when the second tenon engages the fourth hole in the outer shaft.

* * * * *